US005476559A

United States Patent [19]

Chiro

[11] Patent Number: 5,476,559

[45] Date of Patent: Dec. 19, 1995

[54] MAGNETIC SURFACE-MOUNTING PROCESS

[76] Inventor: Joseph A. Chiro, 788 Hanover Rd., Gatesmills, Ohio 44040

[21] Appl. No.: 71,509

[22] Filed: Jun. 3, 1993

Related U.S. Application Data

[63] Continuation-in-part of Ser. No. 695,990, May 5, 1991, abandoned.

[51] Int. Cl.[6] ..... B32B 710; E04F 13/00

[52] U.S. Cl. ..... 156/71; 52/DIG. 4; 156/310

[58] Field of Search ..... 156/71, 310, 315; 52/DIG. 4; 248/683, 467, 205.3, 206.5, 309.4; 211/DIG. 1; 335/285; 40/600

[56] References Cited

U.S. PATENT DOCUMENTS

| | | | |
|---|---|---|---|
| 3,031,799 | 5/1962 | Bradsby | 52/DIG. 4 |
| 3,378,974 | 4/1968 | Bush . | |
| 3,629,756 | 12/1971 | Holtz | 335/285 |
| 4,057,527 | 11/1977 | Columbus | 524/272 |
| 4,309,011 | 1/1982 | Spector | 248/205.3 |
| 4,485,200 | 11/1984 | Perlinski | 523/409 |
| 4,857,374 | 8/1989 | Perry | 428/71 |
| 4,942,071 | 7/1990 | Frye | 428/40 |

FOREIGN PATENT DOCUMENTS

| | | | |
|---|---|---|---|
| 2545079 | 4/1977 | Germany | 52/DIG. 4 |
| 3125931 | 6/1982 | Germany | 40/600 |
| 0913107 | 12/1962 | United Kingdom | 248/205.3 |

*Primary Examiner*—Michael W. Ball
*Assistant Examiner*—Daniel J. Stemmer
*Attorney, Agent, or Firm*—Woodling, Krost & Rust

[57] ABSTRACT

A process is disclosed for preparing a wall surface and objects so that the objects may be applied to the wall surface without the need for damaging the surfaces. Ferrous sheet metal is adhered to the surface and hidden by paint or wall covering so that the objects, provided with magnets, may be located or relocated at any desired position on the surface.

6 Claims, 1 Drawing Sheet

MAGNETIC SURFACE-MOUNTING PROCESS

This is a continuation-in-part application of U.S. Ser. No. 07/695,990 filed May 5, 1991, now abandoned.

BACKGROUND OF INVENTION

This invention relates to a process of preparing new and existing wall surfaces and ceilings for the attachment of fixtures and decorations. In particular it relates to a process of applying various sheet metal types onto a supporting surface such as an existing wall, by use of a peel and stick pressure sensitive adhesive, feathering plaster at the edges to smooth the surface, and covering the metal to allow for the attachment of a wide range of fixtures and decorations at various locations on the supporting surface by use of magnetism without damaging the supporting surface.

BACKGROUND AND DESCRIPTION OF THE PRIOR ART

Consumers of all ages and types are aware that in order to mount a fixture to any wall, they must accept that the wall surface will be damaged by metal nails or screws that secure mounting devices.

Walls covered by paint or wallpaper are subject to damaging effects of the traditional mounting process.

Inventors have created magnetic mounting devices and systems for other purposes, but not for universal wall mounting of any fixture or decoration.

Bush (U.S. Pat. No. 3,378,974) discloses a tile or panel means of covering walls or ceilings by a method of nailing ferrous metal to the wall. Similarities include the securing of metal to a wall or ceiling and the use of magnetic strength to affix tile or panel to these structures. The desired outcome is to simplify the application of tile or panel to the structure. The method does not use pressure sensitive adhesives in the process of installing the ferrous metal, rather it provides for the nailing of ferrous strips to walls or ceilings. The method does not make use of various ceramic magnet types in its means for securing objects of various types of fixtures and decorations. Bush provides only for magnets to be installed in the tiles or panels in the process of manufacturing the tiles. The method provided by Bush does not allow for use of paint or wallpaper to cover the ferrous metal; the metal must be entirely covered by tiles or panels. This process does provide an alternative for securing tiles and panels, but the disclosure does not describe the application of any other functional or decorative fixture to various supporting structures.

Bradsby (U.S. Pat. No. 3,031,799) discloses a means of supporting fixtures by securing brackets to one or more wall studs that hold magnetic devices. This method is limited by the restriction of affixing magnets to a single location in the support surface. This limits the size and weight of fixtures and requires a bolting or nailing of the device to studs. A dismantling of existing covering surfaces is required.

Several other magnetic mounting devices have been proposed: for example, U.S. Pat. Nos. 3,619,934 (1969); 4,184,304 (1980); 3,235,427 (1966); 3,827,020 (1974); 2,528,211 (1950); 2,951,311 (1960); 2,760,275 (1956); 3,124,501 (1964); 2,414,653 (1947); 2,816,380 (1957); 1,193,227 (1916); 2,507,559 (1950); 1,789,124 (1931); and 3,243,374 (1966). Although each discloses magnetic means of support, their proposed processes do not cite the use of pressure-sensitive adhesives for mounting ferrous sheet, nor a versatility in location, nor a versatility in fixture and decoration types. Some disadvantages of the above mentioned device methods include the following: They are limited as a specific means of securing wallpaper or fabric, intending magnets to be imbedded in plasterboard for support. They are intended for use in building miniature models in planning and designing, not for full scale application. They are specifically intended for use on metal contained appliances such as refrigerators. They provide for the use of affixed brackets to supporting means by nailing, bolting, or screwing of brackets to studs, requiring the dismantling of existing supporting means; this is not simple or cost effective for the average consumer as restoration of the supporting surface is required for the existing structure. The versatility of the supporting device is limited to single locations where brackets are installed. Other inventions include uses on floors for securing carpeting, window cleaning devices, and data charts; all are radically different purposes and methods for support.

OBJECTS AND ADVANTAGES OF THE INVENTION

My invention provides for a process accessible to the average consumer and allowing for a more full range of capabilities. Basically, as originally conceived, it comprises applying a pressure-sensitive adhesive to one side of a large ferrous sheet, applying the sheet to a wall surface, and putting paint or wallpaper over the sheet to obtain a wall surface which looks like a normal wall but is magnetically susceptible. Then the homeowner or tenant adheres magnets to the back of objects desired to be supported on the wall; these objects may then easily be placed wherever desired, and moved whenever desired to other locations without damage to the wall.

In the practice of the invention it was discovered that the sheet metal would often eventually loosen from the wall. The inventor and his associates have conducted extensive experimentation to discover the causes of this problem and means for its solution. They found that pressure-sensitive adhesives (including rubber-based and acrylic-based) by themselves do not provide a sufficient bond. Attempts to vary the thickness of the adhesive layer revealed shortcomings. If the layer of pressure-sensitive adhesives is too thin, there is not sufficient adhesive to achieve a tight bonding of the metal to the wall surface. If the layer is too thick, the adhesive is too vulnerable to movement caused by climatic changes, and paint applied over the metal sheets is subject to highly visible cracking at the joints between the sheets or at the final edges of the sheets.

It was further determined that the nature of the pre-existing wall surface is highly influential upon successful bonding of a pressure-sensitive adhesive. Wall surfaces present numerous variables in terms of the surface composition, such as content of oil, allowance for air penetration, and surface coatings. Examples of common wall paints include primer paints, enamel-based paints and latex-based paints. Bare drywall is another example of a wall surface that may affect the practice of the invention. Paints may contain various resins, plasticizers, solvents and other additives to improve durability, stability and appearance of paint products. These additives often cause an inadequate adhesion of pressure-sensitive adhesives to wall surfaces, with the result that the bond will eventually fail.

An exhaustive series of experiments with various primer coatings was then carried out, and it was found that no primer coating currently available sufficiently stabilizes the various surfaces to overcome the effects of paint additives and to ensure adequate adhesion of pressure-sensitive adhesives to wall surfaces. Primers contain similar solvents as paints. The principal purpose of a primer coating is to provide a receptive surface for paints, not adhesives. Primer coatings are not intended to provide for surfaces that may support the bonding strength which is necessary for the adhesion of metal sheets nor the objects to be mounted against the metal sheets. (Testing of these coatings was performed with assistance from members of the technical staff of Fasson, a specialty tape division of Avery International Corporation. Fasson is located in Mentor, Ohio).

Other types of adhesives were investigated. In particular, liquid contact adhesives were tried. These adhesives were designed to bond two surfaces together by applying the adhesive to both surfaces, waiting for a specified period of time, typically between 30 minutes and four hours, and then pressing the surfaces together. Any application performed outside the recommended window in time subjects the process to the likelihood of bonding failure, since apparently a certain proportion of solvent must have remained in the adhesive at the time of contact. The experiments revealed that in addition to messiness and other problems of applying the contact adhesive to metal, no environmentally safe contact adhesive in itself provides the necessarily strong bond of galvanized metal to wall surfaces. The contact adhesive provides sufficient contact to wall surfaces, but not to galvanized metal sheets. Some highly toxic contact adhesives will achieve an adequate bond, but they are not recommended due to the safety problems associated with their use.

The problem has finally been solved. The inventor discovered that if the wall is treated with a neoprene-based contact adhesive, it will accept the pressure-sensitive adhesive coating on the sheet metal. The new process requires a longer drying time than usually used with contact adhesives, enough so that solvents in the contact adhesives may evaporate completely, allowing the contact adhesive to act like a primer so that it may be applied against different types of adhesives, such as pressure-sensitive adhesives, to create a strong bond. This is thought to be a new use for contact adhesives.

In summary, the prior art fails to suggest the potential weaknesses in the bonding of metal sheets to wall surfaces using adhesives, and does not compensate the failures which are inevitable as evidenced by numerous tests of these materials in various conditions of temperature and humidity. There are two principle objectives for the adhesives necessitated by the process of adhesively mounting metal sheets to wall surfaces: 1) to provide a sufficient permanent bond of the metal to wall surfaces, and 2) to provide a layer of adhesives of minimal thickness to prevent movement of adhesives; such movement causes cracks through the decorative layer along the edge of the metal sheets. There is no liquid contact adhesive or pressure-sensitive adhesive that by itself can accomplish both these objects, nor is there any adhesive that has been developed for this intended use. Further, there is no primer coating that provides a surface sufficient for bonding against pressure-sensitive adhesives.

The application of contact adhesive as a primer coating provides a stabilizing effect on various wall surfaces necessary for bonding against the pressure-sensitive adhesives provided on metal sheets. This process overcomes the damaging effects that solvents have on paints and pressure-sensitive adhesives, and it provides for a strong bonding of metal against wall surfaces for the object of magnetically mounting objects to walls.

Thus, one object of the invention is to provide easy application of ferrous sheets of various thicknesses with a pressure-sensitive peel and stick adhesive to existing or new supporting structures without extensive modification to the structures.

A further object is to provide a means for covering the ferrous sheets with paint or wallpaper for a standard finish.

A further object is to provide a means for affixing fixtures, decorations, and/or any objects consumers may desire to attach to supporting structures using magnetism as the securing force.

A further object is to provide standard measures for weight allowances for fixtures and decorations to be mounted.

A still further object is to provide for the ability for consumers to affix fixtures and decorations in various positions on the supporting structure, and for the easy removal and re-application of fixtures and decorations without damaging effects to the structure.

The process further allows for use in any indoor room so desired. The process provides for a long-lasting improvement to the interior supporting structure that may be repainted or wallpapered as many times as desired.

Other objects and a fuller understanding of this invention may be had by referring to the following description and claims, taken in conjunction with the accompanying drawing, in which:

FIG. 1 is a sectional view showing a fixture that is fastened to a supporting structure by use of a magnet.

DETAILED DESCRIPTION OF A PREFERRED EMBODIMENT

Figure 1:
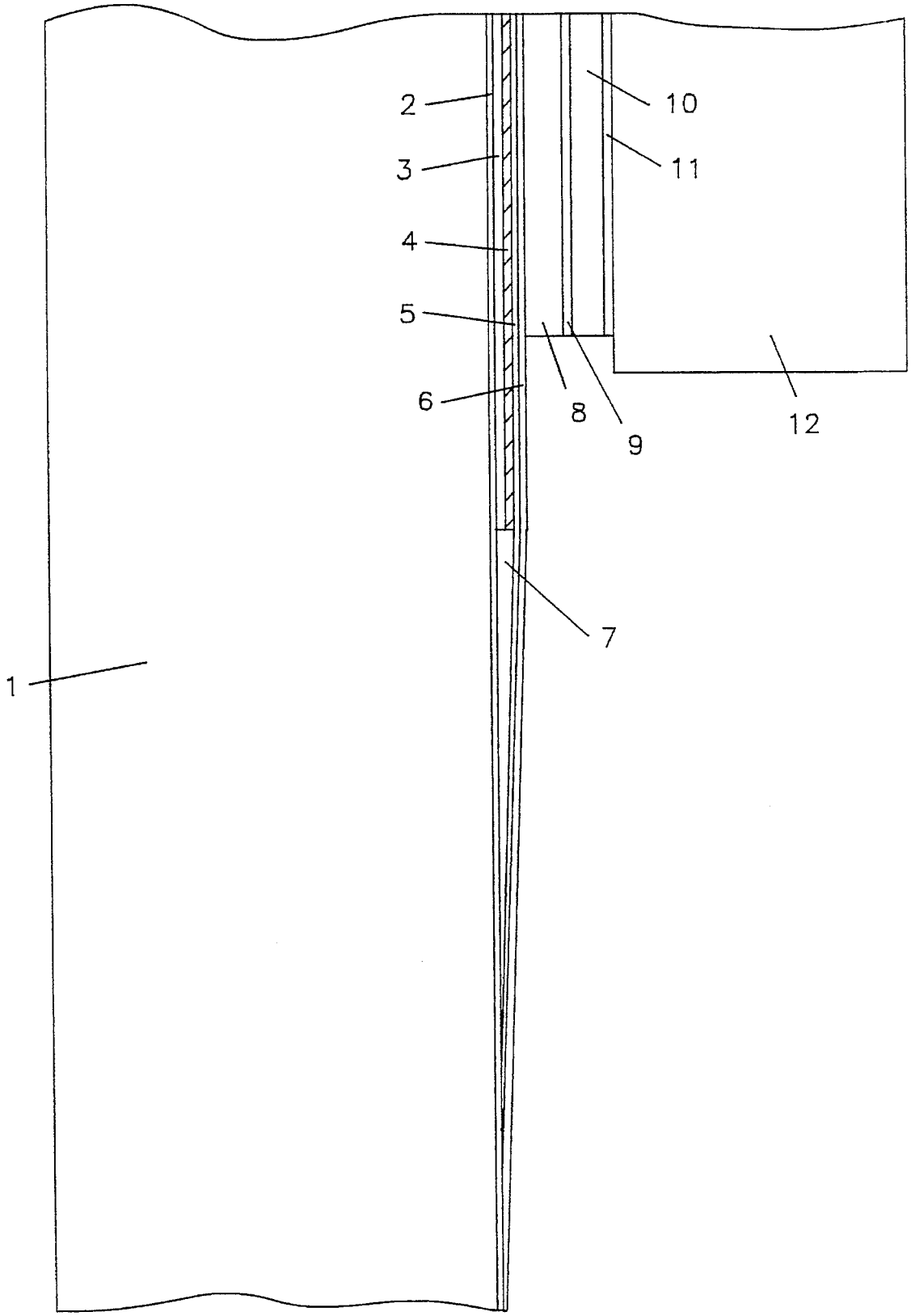

To practice the invention one begins by insuring the supporting surface 1 is void of all dirt, grease, oil, wax, wallpaper adhesive, and loose paint. The supporting structure surface 1 should be flat and smooth. Areas on the supporting structure that require repair should be repaired using a drywall compound and a trowel to smooth the surface, and primed with a premium quality primer sealer 2 to insure proper bonding of adhesives. Unpainted drywall or plaster should also be prepared with the primer. Sound, previously painted surfaces ordinarily need not be reprimed.

After any necessary repair and priming, a light coat of liquid contact adhesive is applied to the wall surface with a roller or brush and allowed to dry for at least 8 hours, keeping it clean from dirt or dust. High gloss surfaces need to be sanded prior to the application to allow penetration of solvents in the liquid contact adhesive through the existing paint surface.

One example of a liquid contact adhesive that performs well as a stabilizer for wall surfaces is 30-NF, manufactured by the 3M Corporation. This adhesive has a Neoprene (Polychloroprene)-based solvent, is very easy to apply, is safe to the end user and to the environment, and allows for easy clean-up of excess adhesive and of tools. The material safety data sheet of the 3M "FASTBOND" 30-NF contact adhesive indicates a composition of: water 40–50%; polychloroprene 30–40%; glycerol ester of hydrogenated rosin 1–10%; phenal-alphapinene resin 1–10%; zinc oxide 1–10%; toluene less than 3%, methyl alcohol less than 2.5%, and tall-oil rosin less than 1%. "FASTBOND" is a trademark of 3M. Another suitable adhesive is 4268NF Industrial Adhesive, also made by 3M. The material safety data sheet of the 3M "SCOTCH-GRIP" 4268 NF adhesive indicates a composition of: water 45–55%; acrylic polymer 20–30%; glycerol ester of hydrogenated rosin 1–10%; phenol-alphapinene resin 1–10%; toluene 1–10%; and methyl alcohol 1–10%. "SCOTCH-GRIP" is a trademark of 3M. Several adhesives were tested that bonded well, but damaged some paints. These were the following: Weldwood Contact Adhesive, Non Flammable, Weldwood Contact Cement (Flammable or Non Flammable), all made by Dap Products, and Marstik 650 or Marstik 130, made by Morton International Products. It is recommended that if any of these adhesives are used they be tested on a small area of wall first; if unsuitable, wrinkling of the paint will occur within 30 minutes. Some adhesives should not be used as they do not provide a strong bond; these were 3M Products' 4224 NF Pressure Sensitive Adhesive, Spray 80 Neoprene Contact Adhesive and Spray 77 Adhesive; and Plaster Weld Glue.

The longer drying time is recommended to ensure that all solvents in the liquid contact adhesive have evaporated prior to application of the metal sheets. These solvents tend to attack the properties of the pressure-sensitive adhesive on the metal sheets causing poor bonding of the two adhesive layers. Common solvents such as ketones, esters, and alcohols require varying times to evaporate due to their molecular composition. The 8 hour drying time is recommended under normal conditions of room temperature and humidity; however, various climates may require more or less drying time. Allowing the liquid contact adhesive to dry overnight will be sufficient under most conditions.

Once applied to the wall surface, the contact adhesive may act as a receptive primer coating for a period of several days under normal conditions. It is recommended that the process of attaching the metal sheets to the adhesively primed wall surfaces is performed within 120 hours as the risk of contamination increases with time. The exposed surface may be adversely affected by dust or dirt or any other foreign matter that may contact the surface, thus leaving a bond that may be susceptible to failure.

Very thin sheet metal 4 may be cut in various size squares that nearly fit together when attached by an adhesive to the supporting structure such as a wall or ceiling. The ferrous sheets 4, preferably galvanized, may be cut from a few square inches to several square feet in size. Fewer cuts of ferrous sheets on the supporting structure are preferred so as to lessen the potential of sheet seams showing through on painted or wallpapered surfaces. The ferrous sheet material is available from Decker Steel and Supply Inc. and any manufacturer of galvanized sheet metal used in production of heating ducts.

Gauge is a method of measuring the thickness of sheet steel. The smaller the number in gauge the thicker the material. Presently the thinnest galvanized sheet metal readily available is 30 gauge which is the equivalent of $^{17}/_{1,000}$ of an inch. It has been found through practicing the invention that metals thicker than $^{17}/_{1,0000}$ of an inch can be used, but there is more difficulty in handling the material and feathering the edges to the supporting structure. If a thinner galvanized sheet metal is available, it would function in the practice of the invention but magnetic pull reduces as the mass of the metal is reduced, and it will be clear that more magnets will be necessary.

With the metal reduced to desired size, one side of the ferrous sheet 4 should be roughened by an abrasive, preferably 80 or 100 grade, so that an adhesive could adhere tightly. The adhesive 3 may be a sprayed-on or painted-on pressure-sensitive glue. The adhesive 3 may have a cover paper that is peeled off at the time of installation. A high tack adhesive transfer tape also may be used for installation. The use of contact adhesive on the metal while possible is not advised; in addition to the difficulty of application already mentioned, this process tends to easily form air pockets that prevent 100% adhesion causing visible perforations in the finished surface. Use of pressure-sensitive adhesive 3 is preferred because it simplifies application of a ferrous sheet 4 to the supporting structure; the end user has only to peel the protective paper from the adhesive 3, and the ferrous sheet 4 is ready to be applied to the supporting structure 1 in the desired locations. The 5 Mil thick pressure-sensitive adhesive used in the presently preferred embodiment is the 9755PC Adhesive Transfer, manufactured by 3M Company. "SCOTCH BRAND" F-9755 PC is a medium firm acrylic adhesive tape. "SCOTCH" is a trademark of 3M. Flexcon Company and others manufacture similar pressure-sensitive adhesives.

The metal 4 should not be installed within three inches of electrical outlets or switches.

It is important to note that oversized ferrous sheets have a tendency to ripple around the edges of the sheet after application to the supporting structure, creating difficulty in feathering plaster to smooth the surface. The assembly of smaller (1'×1' or 3'×3' or 4'×4') squares is advisable.

It is preferred to round the corners of the metal sheets before installing them upon the wall. This is because right angle corners tend to have a weaker bond than rounded corners due to the small surface area at the pointed corners. This area on the sheet is most vulnerable due to its lower adhesive coverage. The weak adhesion may allow the corner to lift, thus allowing more air to penetrate the adhesive and causing further damage to the bond. Rounding of metal corners substantially reduces the likelihood of such failure.

Also, the sheets should not be butted directly against each other; a gap of ¼ to ½ inch is preferably provided. This provides sufficient space and flexibility for movement of metal sheets caused by expansion and contraction of adhesives under normal climatic changes.

To hide the ferrous sheet, the surface may be prepared with a thin coat of feathered drywall compound or plaster 6 to smooth the edges of the metal. Once the ferrous sheet 4 is in place the gaps and final edge are prepared with a standard drywall compound 7, such as that used in finishing of drywall. The drywall compound 7 should be feathered to smooth the edge of the metal 4 against the supporting structure's surface 1. Starting from the outer edge of the metal, which may be $^{21}/_{1,000}$ of an inch in thickness, the compound should gradually taper down to $^{1}/_{1,000}$ of an inch or less. The tapering effect may extend approximately 3" to 6" from the metal edge. The drywall compound should not cover the ferrous sheet; it is desired to blend the metal surface into the surface of the supporting structure.

Next a premium quality paint sealer 5 is applied on the surface. The area of supporting structure to be covered is at the discretion of the consumer. For example, a one foot ribbon of metal may be applied around a window for installation of a magnetic window covering if it is not desired to treat the entire wall.

At this point the final covering may be applied to the surface. Any paint or wallpaper 6 may be applied to decorate the surface. The above materials are commonly available from any paint supply, hardware, or building supply center.

The thickness of paint on the surface has a negligible effect on magnetism. Wallpaper may slightly reduce the magnetic strength, but heavier vinyl, cloth or Sanitas$^{R}$ may greatly reduce magnetic strength. A thinner wallpaper, such as 10/1,000 of an inch in thickness, is recommended to maintain full magnetic potential.

Magnets of various strengths may then be applied to fixtures and decorations of any type and secured to supporting structures; this could include wall pictures, mirrors, curtains, window dressings, small shelves, lamps, towel holders, and any fixture or decoration desired by the consumer. It is greatly preferred to use the thin flexible ceramic magnetic sheets or strips now widely available.

A double-sided adhesive foam is preferably secured between the ceramic magnet and the object to be affixed to the supporting structure. This allows the magnet or magnets to conform to uneven surfaces of the supporting structure, either because a single long flexible strip can hug the wall, or because a number of small non-flexible magnets may each adjust to a different position. The soft foam 10 which may vary in thickness should have adhesive 9, 11 on both sides. For example, a foam of 1/16" thickness should first be applied to the back side of the magnet 8 using a peel and stick adhesive. This assures for a more solid adhesion of a magnet to a ferrous sheet. The foam may be pre-applied to the magnet during packaging to allow for easy application by the end user; the protective paper coating may simply be peeled off and the foam-backed magnet is ready to be secured to a fixture. The foam is available at any home improvement center or hardware store and is manufactured by 3M and Manco (a Cleveland-based manufacturer of adhesives) and others.

The magnets used should vary proportionally with the size and shape of the fixtures and decorations to be secured and also with the thickness of the said wallcovering. The magnet 8 may be permanently applied to fixture or decoration 12; a peel and stick adhesive 11 may be used to secure the magnets. The size and number of magnetic strips should vary according to the weight of the object 12 to be secured to the supporting structure. The magnets used in these examples were manufactured by Magnetic Specialty, Inc. of Marietta, Ohio.

Specifications concerning magnetic pull strength of these magnetic strips are available from Magnetic Specialty, Inc. For example, a magnet strip that is 1' in length, 1" in width, and of 0.045" thickness has a minimum pull strength of 7.5 pounds at zero air gap. A magnet strip that is 1' in length, 1" in width, and of 0.085" thickness has a minimum pull strength of 15 pounds at zero air gap. Minimum pull strength per magnet may vary between manufacturers of the magnets.

For example, it is preferred that magnetic strips of 1/16" thickness and ½" width are secured around the perimeter of the back side of 12"×16" wood picture frame (approximately 2½ pounds in weight). The magnets consist of a flexible ceramic material and may easily be cut to size with a razor cutter or scissors. The magnets may be obtained from manufacturers in rolls of various lengths so that installation in this process allows for precisely measured cuts with no waster of material. Larger magnets with the same adhesive backing should be used to secure larger and heavier fixtures such as shelves or lamps.

If sold with the ferrous sheets, the magnets should be packaged with detailed weight limits per square inch, per foot, and per linear foot (also metric equivalents) as guidelines for the end user for determination of appropriate size and weight of magnets needed to secure objects to supporting structures.

This process is an an alternative to the standard hammer and nail process. It may be used in any residential or commercial setting on unlimited supporting structures. End users may change the arrangement of fixtures or decorations as frequently as desired without causing damage to the supporting structure.

The invention has been described in detail with particular emphasis on the preferred embodiments thereof, but it should be understood that variations and modifications within the spirit and scope of the invention may occur to those skilled in the art to which the invention pertains.

What is claimed is:

1. A process for mounting an object on a wall using a contact adhesive and an acrylic pressure sensitive adhesive, said contact adhesive comprising 40–50% water, 30–40% polychoroprene, 1–10% glycerol ester of hydrogenated resin, 1–10% zinc oxide, less than 3% toluene, less than 2.5% methyl alcohol, and less than 1% tall-oil rosin, said process comprising the steps of:

applying a coat of said contact adhesive to said wall;

drying said coat of said contact adhesive applied to said wall;

applying said pressure sensitive adhesive to a first side of a ferrous sheet at least 30 gauge in thickness;

applying said first side of said ferrous sheet having said pressure sensitive adhesive thereon against, and into engagement with, said wall having said contact adhesive thereon;

applying a covering over said ferrous sheet;

affixing a magnet to said object; and, placing said magnet against said covering whereby said magnet and said ferrous plate are mutually attracted to each other and said object affixed to said magnet is held in position with respect to said wall.

2. A process for mounting an object on a wall as claimed in claim 1 wherein said step of applying a covering over said ferrous sheet includes a covering comprising paint.

3. A process for mounting an object on a wall as claimed in claim 1 wherein said step of applying a covering over said ferrous sheet includes a covering comprising wallpaper.

4. A process for mounting an object on a wall as claimed in claim 1 further comprising affixing a plurality of magnets to said object.

5. A process for mounting an object on a wall as claimed in claim 1 wherein said magnet is a ceramic magnet.

6. A process for mounting an object on a wall using a contact adhesive and an acrylic pressure sensitive adhesive, said contact adhesive comprising 45–55% water, 20–30% acrylic polymer, 1–10% glycerol ester of hydrogenated rosin, 1–10% phenol-alphapinene resin, 1–10% toluene, and 1–10% methyl alcohol, said process comprising the steps of:

applying a coat of said contact adhesive to said wall;

drying said coat of said contact adhesive applied to said wall;

applying said pressure sensitive adhesive to a first side of a ferrous sheet at least 30 gauge in thickness;

applying said first side of said ferrous sheet having said pressure sensitive adhesive thereon against, and into engagement with, said wall having said contact adhesive thereon;

applying a covering over said ferrous sheet;

affixing a magnet to said object; and, placing said magnet against said covering whereby said magnet and said ferrous plate are mutually attracted to each other and said object affixed to said magnet is held in position with respect to said wall.

* * * * *